United States Patent [19]
D'Andrade et al.
[11] 4,409,753
[45] Oct. 18, 1983

[54] POWERED TOY BOAT

[75] Inventors: Bruce M. D'Andrade, Whitehouse Station, N.J.; Fun S. Mak, Hong Kong, Hong Kong

[73] Assignee: Arco Industries Ltd., Hong Kong, Hong Kong

[21] Appl. No.: 373,423

[22] Filed: Apr. 30, 1982

[51] Int. Cl.[3] ..... A63H 23/02
[52] U.S. Cl. ..... 46/93; 46/206; 185/DIG. 1
[58] Field of Search ..... 46/93, 91, 94, 92, 96, 46/206, 208; 185/DIG. 1, 37, 39, 9, 10, 46

[56] References Cited

U.S. PATENT DOCUMENTS

| | | | |
|---|---|---|---|
| 1,340,614 | 5/1920 | Kingsbury et al. | 46/93 |
| 1,914,438 | 6/1933 | Labin | 46/206 |
| 2,749,660 | 6/1956 | Zimenstark | 46/206 |
| 3,229,415 | 1/1966 | Bross | 46/206 X |
| 3,656,586 | 4/1972 | Robson | 46/92 X |
| 3,757,459 | 9/1973 | Buck et al. | 46/206 X |
| 4,318,455 | 3/1982 | Lapierre | 185/DIG. 1 X |

FOREIGN PATENT DOCUMENTS

| | | | |
|---|---|---|---|
| 477769 | 1/1938 | United Kingdom | 46/93 |

*Primary Examiner*—Mickey Yu
*Attorney, Agent, or Firm*—C. Hercus Just

[57] ABSTRACT

A toy boat powered by a rubber-band as a source of driving power for a propeller, the rubber band being wound to energize it by a helical type spiral rod adapted to be reciprocated longitudinally within the hull of the boat respectively in opposite directions to wind the rubber band by means of a gear train actuated by the spiral rod when moved in one longitudinal direction and clutch structures being included to permit sequential retraction of the spiral rod while the rubber band is prevented from unwinding during such retraction without the use of a locking member or the like.

10 Claims, 5 Drawing Figures

POWERED TOY BOAT

BACKGROUND OF THE INVENTION

The operation of toy boats has long been a favorite hobby with children as well as with certain adults. The production and sailing of miniature sailboats is one form of this hobby, while the operation of powered miniature or toy boats represents another aspect of the hobby. The present invention pertains to the latter field of the hobby.

There is presently available on the market a variety of different types of powered boats operated, for example, by means of dry cell batteries for purposes of furnishing power to electric motors to which the propellers of the boats are connected. One drawback of using batteries to propel electric motors for this type of boat resides in the fact that the consumption of power by the motors is substantial and, depending upon the frequency of operation of the boat, frequency replacement of such batteries becomes necessary.

One of the principal objects of the present invention is to utilize readily available and effective power means in the form of an elongated elastic band, such as a rubber band of suitable size and power, which is adapted to be twisted until sufficient power is stored therein that, when released, unwinding of the twisted elastic band is adequate to drive the propeller of a boat for a substantial period, due particularly to the friction imposed upon the propeller by the water through which the boat moves. The only renewable aspect of such type of power means being the need to replace the rubber band in the event it becomes broken or worn to such extent that effective use is no longer practical.

Powered toy boats utilizing spring means or twistable elastic means to furnish the power for driving the propeller of the same have been embodied in toy boats previously designed and developed. For example, prior U.S. Pat. No. 1,340,614 to Kingsbury et al, is directed to a toy boat in which a very simple means to drive the propeller is provided in the form of one or more rubber bands adapted to be twisted by means of a manually operable crank connected to the propeller. As is well known, winding a rubber band by means of such a simple crank element is very time consuming in the absence of any ratio increasing mechanism which is absent in the Kingsbury et al structure.

Toy wheeled vehicles also have employed coil spring and rubber band type means to drive an axle of the vehicle to which the drive wheels are connected. By way of example, prior U.S. Pat. No. 1,914,438 to Labin, dated June 20, 1933, shows a coiled tension spring connected at one end to one end of the vehicle and the opposite end is connected to an elongated twisted rod in the form of a helix which is adapted to be pulled from a retracted position within the body of the wheeled toy to an extended position, whereby the spring is placed under substantial tension and, when the twisted rod is released, the spring contracts and pulls the twisted rod non-rotatably through a slot in a gear resembling a ring gear having teeth adjacent the periphery and engageable with a small pinion gear fixed to the axle of the vehicle upon which the drive wheels are mounted. A mechanism is also provided to automatically disconnect the motor from the drive mechanism when the energy of the spring has been extended and thereby permit the vehicle to coast a greater distance than that provided by the driving mechanism.

A vehicle in which a rubber band motor is provided for driving means similar to that of Labin comprises the subject matter of prior U.S. Pat. No. 2,749,660 to Zimenstark, dated June 12, 1956, and in which one end of a rubber band is connected to a ring gear associated with a spur gear on the driving axle of the vehicle and the other end of the rubber band is connected to a loop on a shaft adapted to be rotated by means of a hand-operated key element inserted through the forward end of the vehicle and, as in the patent of Kingsbury et al, very slow rotation of the rubber band can be effected.

The most pertinent known prior art to the present invention comprises a British patent, No. 477,769 to Lobb, dated Jan. 3, 1938, and pertaining to a toy boat in which an elongated rubber band is disposed in a manner to drive the propeller by means of a spirally twisted elongated member mounted for rotation about a fixed axis and along which a coengaging nut can be pulled by an elongated rod in one direction to operate gearing that drives a small shaft to which one end of the rubber band is connected. When the elongated rod is moved in the opposite direction, a clutch is operated to permit such opposite movement of the rod without unwinding the partially or fully wound rubber band due to the provision of a pivoted lever comprising a stop means to engage a large diameter gear wheel of the gear train and prevent rotation thereof.

SUMMARY OF THE INVENTION

It is among the foregoing objects of the present invention to provide a powered toy boat comprised of a hull in which a gear train is mounted within the hull adjacent the stern end thereof and a helical type spiral rod extends longitudinally within the hull and extends through a slot in a first clutch member engageable with a first gear of said gear train for rotation of said gear in opposite direction when the spiral rod is reciprocated respectively in opposite direction, and a propeller is supported exteriorally of the stern end of the hull upon one end of a drive shaft supported by bearings within the supporting frame for the gear train, an elongated elastic band connected at one end to fixed means in the bow of the hull and the opposite end being connected to said drive shaft upon which a drive gear of said gear train is connected and a second gear in gear train is interengageable between said first gear and drive gear, the drive mechanism also including a second clutch interconnected between said propeller and drive shaft and operable to permit manual restraint of the propeller against rotation when winding of the band is occurring, whereby when the spiral rod is pulled outwardly relative to the hub, the first clutch member drivingly engages the first gear to activate the gear train to rotate the drive gear in a direction to wind the elastic band while the propeller is manually restrained from rotation and, when said spiral rod sequentially is pushed inwardly, it ratchets to disconnect the first clutch to render the gear train motionless and coengaging members of the second clutch are engaged to prevent the twisted elastic band from unwinding, and said sequence is repeated until the band has been wound to a desired degree.

Another object of the invention is to provide means relative to said gear train by which the first gear is supported for rotation about a fixed longitudinal axis and said first clutch member is engageable with a companion clutch member fixed to said first gear and being mounted for limited axial movement upon said spiral rod to effect engagement and disengagement between the clutch members respectively during pulling and pushing movements of the spiral rod.

A further object of the invention is to provide the supporting frame for the gear train in the form of a pair of substantially parallel frame plates spaced apart to accommodate the gear train, one of said frame plates supporting a housing member enclosing said first clutch member and extending toward the other frame plate and said companion clutch member being fixed to one face of said first gear which is rotatable adjacent said housing member and supporting a guide sleeve extending outwardly from the opposite face of the first gear to receive said spiral rod slideably, the other frame plate also having a bearing opening rotatably receiving said guide sleeve.

Still another object of the invention is to provide on the drive gear of said gear train hub means disposed between said frame plates which have bearing openings therein for said drive shaft, and said drive shaft being axially movable a limited distance between said frame plates to permit engagement and disengagement of the members of said second clutch.

One further object of the invention is to arrange said frame plates respectively to support said first and second gears and said drive gear substantially within a common plane parallel to the frame plates, and said frame plates having axially aligned short slots parallel to each other and supporting the opposite ends of the shaft for said second gear for sequential movements of said second gear between one position relative to said slots for driving coengagement with said first gear and drive gear when said spiral rod is being pulled axially outward to wind said elastic band, and the second position in which said second gear disengages said first gear and drive gear to permit rotation of said drive shaft and propeller by said elastic band without interference with the gear train.

Still another object of the invention ancillary to the foregoing object is to provide a spring having interengagement with said second gear and operable to move the same to disengage it from said first gear and drive gear when the elastic band is driving said propeller with said second clutch in operative position between said drive shaft and propeller.

One further object of the invention is to provide said second clutch means between one end of a hub on said propeller and a tail member fixed to the outer end of the drive shaft whereby, due to the propeller being mounted upon the drive shaft for free relative rotation during winding movement of said elastic band, the drive shaft will have limited reciprocation relative to said propeller during said winding of the elastic band while the propeller is being manually restrained against rotation.

DETAILED DESCRIPTION OF THE PREFERRED EMBODIMENTS OF THE INVENTION

Figure 1:
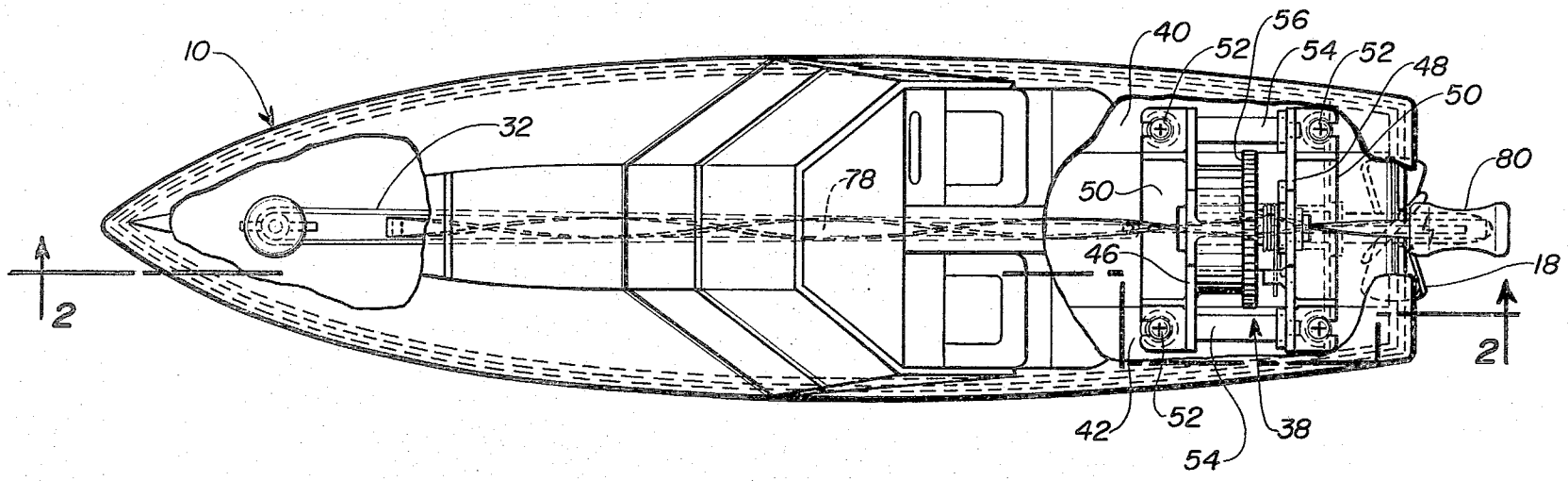
FIG. 1 is a plan view of a toy boat having power means embodying the principles of the present invention and the forward part of the deck being broken away to expose a detail of the structure.
Figure 2:
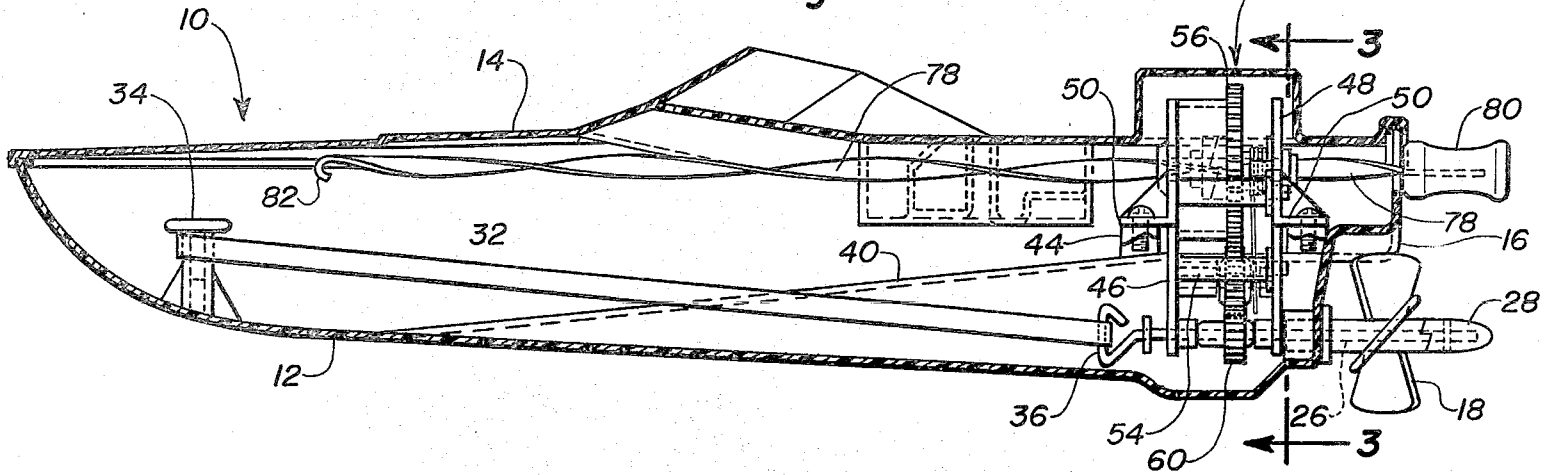
FIG. 2 is a vertical elongated sectional view of the toy boat shown in FIG. 1 as seen on the line 2—2 thereof.

Referring particularly to FIGS. 1 and 2, an exemplary toy boat 10 is illustrated which comprises a hull 12 and a deck and windshield 14, the edges of which are suitably connected to the rim of the hull 12 in any suitable manner. Preferably, the hull 12 and deck and windshield 14 are suitably molded from synthetic resin or plastic material by appropriate molds, but it is to be understood that said elements may be made from other material such as metal, paper fiber, or otherwise. Also, the stern 16 of the hull is molded or otherwise formed integrally with the hull 12.

Figure 4:
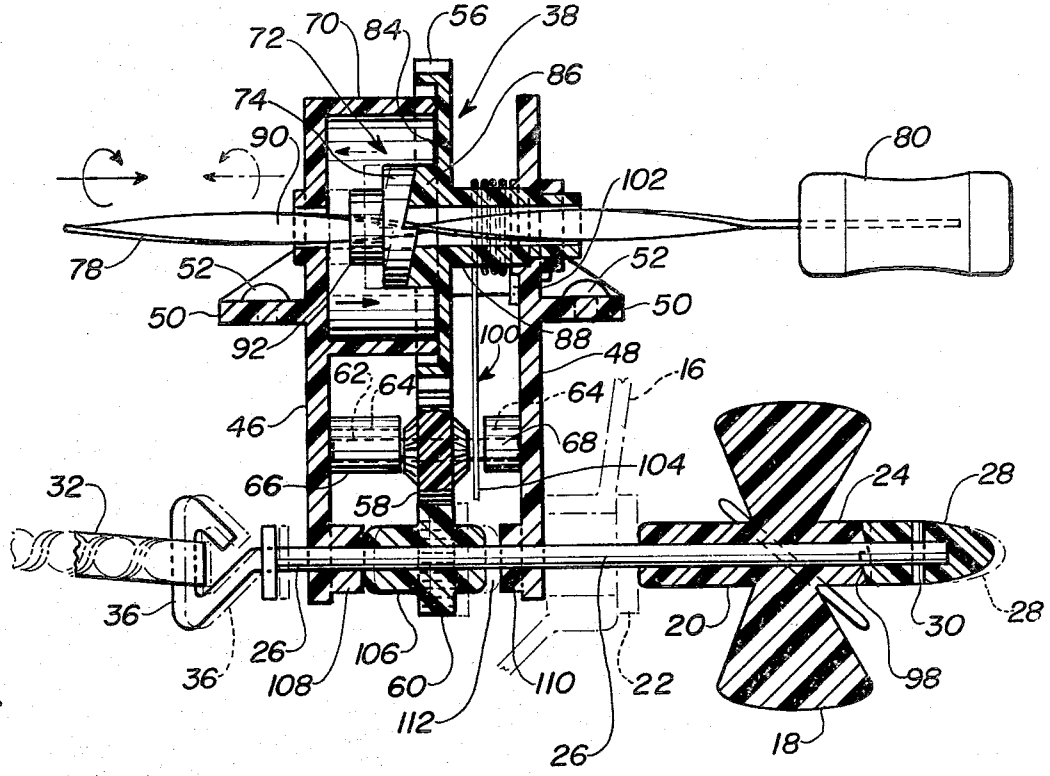
FIG. 4 is a vertical sectional view of the gear mechanism shown in FIG. 3 as seen on the line 4—4 thereof, a fragmentary end of the rubber band of the power means being connected to the drive shaft of the propeller and relative positions of different parts of the several clutch members of the mechanism being illustrated respectively in full lines and phantom, and the fragmentary part of the stern of the boat hull being shown in phantom with respect to the drive shaft.

The boat 10 is driven by a propeller 18 which, also, preferably is formed by molding the same from plastic material of suitable hardness and durability, said propeller also preferably having a hub 20 formed integrally therewith, the forward end of the hull abutting a thrust bearing 22 which is provided in a suitable opening in the stern 16 of the hull 10 as shown in FIG. 4, the hub 20 also having a rearward projection 24, the outer end of which comprises part of a clutch unit identified hereinafter as a second clutch which operates with respect to the propeller or drive shaft 26, the rearward end of which has a tail member 28 connected thereto by a pin 30, the forward end of the tail member 28 having a complementary clutch surface coacting with the corresponding clutch member on the outer end of rearward projection 24 of the hub 20 of the propeller, the function of which is for purposes to be described hereinafter.

The principal purpose of the present invention is to provide power means for the boat 10 which is not dependent upon frequency renewable sources such as dry cell batteries or otherwise as is popular in many types of toy boats available today. Instead, the power means for the present invention comprises an elastic band means 32 of elongated nature. Said means may be composed of one or more rubber bands of suitable size, durability and appropriate tension whereby, when the band means is twisted to a desired extent, it will be fully adequate to drive the propeller in a direction to move the boat 10 forward in a body of water a satisfactory distance. The band means 32 is twisted as desired by mechanism carried by the boat and described hereinafter. Opposite ends of the band means 32 respectively are connected to a fixed anchor member 34 which is disposed in the bow end of the hull 12 and preferably integral therewith and having a head suitable to prevent upward movement of the end of the elastic means 32 connected thereto. The opposite end of the elastic means 32 is connected to an appropriate hook or loop 36 formed in the forward end of the drive shaft shaft 26 in the preferred manner illustrated in FIGS. 2 and 4.

In the prior art, there are examples of rubber band motors for boats and the like which are twisted sufficiently by crank means or other relatively slow methods of twisting the rubber band. To twist the elastic band means 32 in a rapid manner in accordance with the principles of the invention, however, said invention includes relatively simple mechanism in the form of a gear train 38 firmly supported within the hull 12 upon opposite lateral supporting surfaces 40 and 42 from which short abutments 44 project as clearly shown in FIG. 2.

The gear train 38 is disposed between a pair of frame plates 46 and 48 which, preferably, are suitably molded or otherwise formed from plastic material, but metal or other suitable material may be used. Projecting outwardly from outer surfaces of the frame plates 46 and 48 are supporting flanges 50, opposite ends of which are secured to the abutments 44 by means of screws 52. The frame plates 46 and 48 are held in accurate spaced relationship by means of post members 54 shown best in FIGS. 1 and 3, the opposite ends of which are suitably fixedly connected to the frame plates and if desired may be integrally molded with one of the same.

The gear train 38 is relatively simple and consists essentially of three interrelated gears comprising a first gear 56 of relatively large diameter, an intermediate or second gear 58 which is of a much smaller diameter than the first gear 56, and a drive gear 60 of still smaller diameter and secured fixedly to the drive shaft 26. The second gear 58 is primarily a so-called "throw-out" gear which is supported upon a shaft 62 extending between the frame plates 46 and 48 and respectively supported in short slots 64 which are parallel to each other and formed in bosses 66 and 68 which respectively extend inwardly toward each other from the inner surfaces of frame plates 46 and 48 as clearly shown in FIG. 4, the function of the second gear 58 being described below, it being understood that the ends of the shaft 62 which are disposed within the short slots 64 are capable of ready slideable movement therein. Frame plate 46 has a preferably cylindrical housing 70 integrally formed therewith and projecting from the inner face thereof toward frame plate 48 as best shown in FIG. 4, for purposes of enclosing a first clutch unit 72 which is well illustrated in FIG. 4 and comprises a first clutch member 74 which has ratchet teeth on one face thereof and a central slot 76 of limited width and complimentary to the cross-sectional shape of a spiral rod 798 which slideably extends through the slot 76 for purposes of rotating the same as the rod 78 is moved longitudinally as propelled manually by means of a knob 80 on the outer end thereof. The rod 78 is twisted adequately to form a uniform helical configuration and is manufactured from flat strip metallic material in the preferred embodiment but it is conceivable that the same also could be molded from adequate plastic material and particularly such material which has self-lubricating properties such as Nylon. As seen from FIGS. 1 and 2, the spiral rod 78 extends forwardly toward the bow of the hull 12 a substantial distance and terminates in a stop member 82 in the form of a hook or otherwise.

Figure 5:
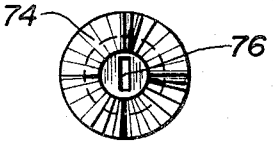
FIG. 5 is an end view of one of the clutch members with which the twisted helical spiral rod of the invention is operable through a slot in said member.

The first gear 56 preferably is provided with a shallow recess 84 in the face thereof nearest the outer end of the cylindrical housing 70, said inner face of the gear being readily movable relative to the terminal end of said housing, the gear 56 otherwise at least partially surrounding said housing as can be envisioned from FIG. 4. The inner face of the first gear 56 is formed with a companion clutch member 86, the outer face of which is complimentary to the ratchet face of the first clutch member 74, the latter being illustrated in plan view in FIG. 5. Projecting from the outer face of the first gear 56 is a guide sleeve 88 which projects through an appropriate bearing opening in the frame plate 48 and the inner diameter of said sleeve is only slightly geater than the width of the spiral rod 78, whereby said guide sleeve is of appreciable length and satisfactorily guides the reciprocating movement of the spiral rod 78 in opposite directions respectively to drive the gear train to wind the elastic band means 32 and then return to inserted, starting position, while the members of the first clutch unit 72 ratchet with respect to each other and the gear train is held immobile as described hereinafter by other means until the next succeeding rearward movement of the spiral rod 78 toward the stern of the hull 12 effects additional winding of the elastic band means 32. Frame plate 46 also has a suitable guide opening 90 through which the spiral rod 78 moves longitudinally.

It will be seen from FIG. 4 that the distance between the face of frame plate 46 and the outer face of hub 92 on first clutch member 74 is adequate to permit axial ratcheting movement between the coengaging members of the first clutch 72, while the companion clutch member 86 and first gear 56 remain within a transverse plane and have no axial movement with respect to the stationary frame plates 46 and 48.

In addition to the first gear 56 having no axial movement with respect to the frame plates, it also is to be noted that the second gear 58 also has no relative axial movement but is transversely movable within the plane of the gear as permitted by the short slots 64 described above. To effect winding of the elastic band means 32, the spiral rod 78 is pulled rearwardly with respect to the boat hull and this causes the gear 56 to rotate clockwise as shown by the arrow 94 in FIG. 3. Engagement of the teeth of the gear 56 with those of the second gear 58 causes the second gear 58 to rotate in the direction of the arrow 96 shown in FIG. 3 and moves the shaft 62 to the left-hand end of the slots 64 as viewed in FIG. 3, thereby establishing meshing of the gears of second gear 58 and drive gear 60 for purposes of rotating the drive shaft 26 and hook 36 thereon in a direction to wind the elastic band means 32 into a twisted, spiral configuration which, when released, is adequate to rotate the drive shaft 26 and propeller 18 in a direction to move the boat forwardly in a body of water.

During the winding of the elastic band means 32 as described, the propeller 18 is manually held against rotation by the person operating the boat and, during the winding operation, the second clutch 98 ratchets in a manner to slightly reciprocate the drive shaft 26 and tail member 28 as well as the hook 36 a limited extent as indicated by the phantom illustrations thereof in FIG. 4, the ratcheting faces of the second clutch 98 being described above with respect to the rearward projection 24 of the hub 20 of the propeller and tail member 28.

After the spiral rod 78 has been pulled rearwardly to effect a winding stroke to twist the elastic band means 32, while still holding the propeller 18 manually to restrain rotation thereof, the knob 80 is then pushed to move the spiral rod 78 forwardly and when this occurs, the first clutch member 74 of first clutch unit 72 ratchets between the full line and phantom views thereof shown in FIG. 4, whereby the gear train remains stationary and no reverse movement of the drive shaft 26 can occur because of the engagement of the ratcheting faces of the second clutch 98 which remain engaged during such returning movement of the spiral rod 78. This constitutes one of the major improvements afforded by the present invention in that no stop lever or other form of device is required to engage any of the gears, for example, as is necessary in certain of the prior art devices and particularly the British patent disclosure.

Figure 3:
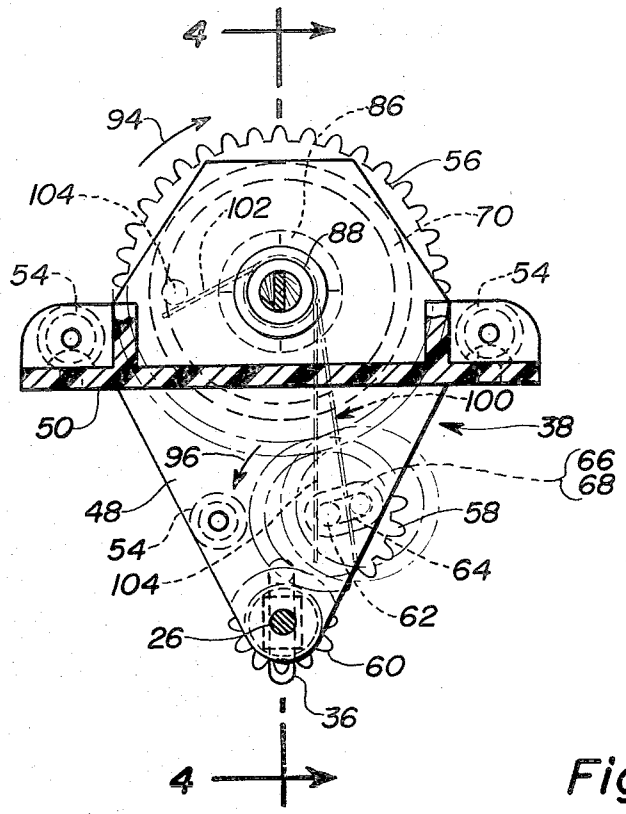
FIG. 3 is a vertical sectional view on a larger scale than shown in FIG. 2 and illustrating details of the gear train of the toy boat shown in FIGS. 1 and 2 as seen on the line 3—3 of FIG. 2.

From the foregoing, it will be seen that the present invention provides especially a relatively simple and highly effective mechanism to operate a gear train to effect spirally winding an elastic band means in a direction which, when released, is effective to drive the propeller of the boat in a manner to move the boat forwardly in a body of water. The winding of the elastic band means 32 in a suitably twisted configuration to effect such driving is accomplished by means of repeated reciprocating longitudinal movements of the spiral rod 78, respectively in successive forward and rearward longitudinal movements accomplished manually by the knob 80 and while the propeller 18 is held manually in restraint against rotation. The first clutch unit 72 ratchets during the return movement of the spiral rod 78, but is engaged in driving relationship upon outward pulling movement of the spiral rod 78 and, during the latter movement, the coengaging ratcheting faces of the second clutch unit move relatively in ratcheting manner to permit rotation of the drive shaft in a direction to wind the elastic band means 32 and during such movement, all of the gears of the gear train 38 are engaged with each other. However, when the spiral rod 78 is moved inwardly incident to providing a successive pulling stroke for winding the elastic band means 32, ratcheting movement between the clutch members 74 and 86 tends to rotate the first gear 56 counterclockwise, as viewed in FIG. 3, and this movement tends to move the second gear 58 in throw-out direction as illustrated by the phantom position thereof shown in FIG. 3, in which the shaft 62 is adjacent the right-hand end of the slots 64 as viewed in FIG. 3, whereby said second gear disengages the drive gear 60. To facilitate such movement of second gear 58 to the disengaged position, the mechanism is provided with a suitable stiff spring 100, preferably formed from spring wire or the like, said spring being coiled around the exterior of the guide sleeve 88 as clearly shown in FIG. 4, said spring having a tail end 102 which, as shown in FIG. 3, abuts a fixed pin 104 projecting inwardly from frame plate 48, and the opposite end 104 of said spring is longer than the tail end 102 thereof and engages the left-hand side of the shaft 62 as shown clearly in FIG. 3 for purposes of biasing the same to the right-hand end of the short slot 64 and thereby facilitate the disengagement of the second gear 58 with drive gear 60. While this is occurring however during such disengagement, the manual restraint of the propeller 18 against rotation provides an effective and simple means to prevent unwinding of the elastic band means 32. However, the disengaged position of second gear 58 is the one in which it occupies when the drive shaft 26 is to rotate in a driving direction to move the propeller in driving direction without conflict with any of the gears due to the driving gear 60 being disengaged by second gear 58 and such disengaged position of the second gear 58 is maintained by the spring 100 as aforesaid.

Lastly, it will be seen from FIG. 4 that drive gear 60 is provided with a hub 106 which preferably extends in opposite directions from opposite faces of the drive gear and the inner faces of the frame plates 46 and 48 respectively are provided with bosses 108 and 110 adapted to be respectively abutted by opposite ends of the hub 106 but providing a short clearance space 112 which permits limited reciprocatory movement adequate to enable the coengaging surfaces of the second clutch 98 to ratchet with respect to each other as illustrated by the respective full line and phantom illustration of the hub 106 and hook 36 as well as the tail member 28 in FIG. 4 and the relative widths of gears 58 and 60 is adequate to permit such axial movement without disengagement.

The foregoing description illustrates preferred embodiments of the invention. However, concepts employed may, based upon such description, be employed in other embodiments without departing from the scope of the invention. Accordingly, the following claims are intended to protect the invention broadly as well as in the specific forms shown herein.

We claim:

1. A toy boat including in combination, a hull, a gear train having a supporting frame mounted within said hull adjacent the stern end thereof, a helical type spiral rod extending longitudinally within said hull and extending through a slot in one first clutch member engageable with a first gear of said gear train for rotation of said first gear in opposite directions of rotation when said spiral rod is reciprocated respectively in opposite directions, a propeller supported exteriorally of the stern end of said hull upon one end of a drive shaft supported by bearings within said supporting frame, fixed anchor means adjacent the bow of said hull, an elongated readily twistable elastic band connected at one end of said anchor means and the other end of said band being connected to the other end of said drive shaft, a drive gear in said train connected to said drive shaft, a second gear in said gear train interengageable between said first gear and drive gear, and a second clutch interconnected between said propeller and drive shaft operable to permit manual restraint of said propeller against rotation when winding of said band is occurring, whereby when said spiral rod is pulled outwardly relative to said hull said first clutch member drivingly engages said first gear to activate said gear train to rotate said drive gear in a direction to wind said elastic band while said propeller is manually restrained from rotation and said spiral rod when sequentially pushed inwardly operating to disconnecting said first clutch to render said gear train motionless and coengaging members of said second clutch being engaged to prevent the twisted elastic band from unwinding, followed by repeating said foregoing cycle until the band is wound to a desired amount.

2. The toy boat according to claim 1 wherein said supporting frame for each gear train has guide means for said spiral rod to maintain the spiral movement thereof about a relative fixed longitudinal axis, and said first clutch member being engageable with a companion clutch member fixed to said first gear and also being mounted for limited axial movement upon said spiral rod to effect engagement and disengagement between said clutch members respectively during pulling and pushing movements of said spiral rod.

3. The toy boat according to claim 2 in which said supporting frame includes a pair of substantially parallel frame plates spaced apart to accommodate said gear train, one of said frame plates supporting a housing member enclosing said first clutch member and extending toward the other frame plate, said companion clutch member being fixed to one face of said first gear and said first gear being rotatable adjacent said housing member and supporting a guide sleeve extending outwardly from the opposite face of said first gear and receiving said spiral rod slideably, and said other frame plate being spaced outwardly from said first gear and having a bearing opening rotatably receiving said guide sleeve.

4. The toy boat according to claim 3 in which said drive gear of said gear train which is fixed to said drive shaft has hub means disposed between said frame plates, bearing openings in said frame plates for said drive shaft, and said drive shaft being axially movable a limited distance between said frame plates to permit engagement and disengagement of the members of said second clutch.

5. The toy boat according to claim 4 further including support means in said hull for said frame plates, and means securing said frame plates to said support means.

6. The toy boat according to claim 1 in which said supporting frame includes a pair of substantially parallel frame plates, means fixing said frame plates relative to said hull, said frame plates respectively supporting said first and second gears of said drive gear substantially within a common plane parallel to said frame plates, said frame plates having axially aligned bearings for said drive shaft, said second gear being fixed to a shaft extending between said frame plates, and said frame plates having axially aligned short slots parallel to each other and supporting the opposite ends of said shaft for said second gear for sequential movements of said second gear between one position relative to said slots for driving coengagement with said first gear and drive gear when said spiral rod is being pulled axially outward to wind said elastic band and a second position in which said second gear disengages said first gear and drive gear to permit rotation of said drive shaft and propeller by said elastic band.

7. The toy boat according to claim 6 further including a spring mounted relative to said supporting frame for interengagement with said second gear and operable to move the same to disengage it from said first gear and drive gear when said elastic band is driving said propeller with said second clutch in operative position between said drive shaft and propeller.

8. The toy boat according to claim 6 in which said drive shaft is supported by axially aligned bearings in said frame plates for limited axial reciprocating movement to permit engagement and disengagement of the coengageable members of said second clutch while said propeller is being manually restrained during winding of said elastic band, and the thickness of said second gear and drive gear being adequate to permit said gears to remain engaged during such limited axial movement for the winding of said elastic band by said pulling movement of said spiral rod as aforesaid and while said drive gear is reciprocating limited amounts during such winding movement of said flexible band.

9. The toy boat according to claim 8 further including a thrust bearing in the stern end of said hull through which said drive shaft extends, and said propeller having a hub engageable at one end with said thrust bearing.

10. The toy boat according to claim 1 in which said propeller has a hub and said second clutch comprises coengageable ratchet means respectively upon one end of said hub and a tail member fixed to the outer end of said drive shaft, said propeller being mounted upon said drive shaft for free relative rotation during winding movement of said elastic band and said drive shaft having limited reciprocation relative to said propeller during said winding of said elastic band while said propeller is being manually restrained against rotation as aforesaid.

* * * * *